US008835367B2

(12) United States Patent
Baum et al.

(10) Patent No.: US 8,835,367 B2
(45) **Date of Patent: *Sep. 16, 2014**

(54) POLYMETHACRYLATES AS HIGH VI VISCOSITY MODIFIERS

(75) Inventors: Marina Baum, Chagrin Falls, OH (US); Haihu Qin, Greer, SC (US); Brent R. Dohner, Concord, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 127 days.

This patent is subject to a terminal disclaimer.

(21) Appl. No.: 13/375,515

(22) PCT Filed: Jun. 2, 2010

(86) PCT No.: PCT/US2010/036990

§ 371 (c)(1),
(2), (4) Date: Feb. 21, 2012

(87) PCT Pub. No.: WO2010/141528

PCT Pub. Date: Dec. 9, 2010

(65) Prior Publication Data

US 2012/0135902 A1 May 31, 2012

Related U.S. Application Data

(60) Provisional application No. 61/184,007, filed on Jun. 4, 2009.

(51) Int. Cl.

| | |
|---|---|
| ***C10L 1/22*** | (2006.01) |
| ***C10M 145/14*** | (2006.01) |
| ***C10M 149/02*** | (2006.01) |
| ***C10M 149/06*** | (2006.01) |

(52) U.S. Cl.

CPC ..... *C10M 145/14* (2013.01); *C10N 2220/033* (2013.01); *C10N 2240/10* (2013.01); *C10N 2230/68* (2013.01); *C10M 2215/28* (2013.01); *C10N 2230/02* (2013.01); *C10M 149/02* (2013.01); *C10M 2207/282* (2013.01); *C10M 149/06* (2013.01); *C10M 2207/283* (2013.01); *C10N 2210/02* (2013.01); *C10M 2209/084* (2013.01); *C10M 2203/1006* (2013.01); *C10N 2220/021* (2013.01); *C10M 2223/045* (2013.01); *C10M 2219/046* (2013.01)

USPC ..... 508/464; 508/469

(58) Field of Classification Search

CPC ..... C10M 145/14

USPC ..... 508/464, 469

See application file for complete search history.

(56) References Cited

U.S. PATENT DOCUMENTS

| | | | | |
|---|---|---|---|---|
| 3,397,146 | A | 8/1968 | Cupper et al. | |
| 4,867,894 | A | 9/1989 | Penneweiss et al. | |
| 5,763,374 | A | 6/1998 | Sakai et al. | |
| 5,834,408 | A | 11/1998 | Mishra et al. | |
| 5,969,068 | A * | 10/1999 | Bryant et al. | 526/265 |
| 6,124,249 | A | 9/2000 | Seebauer et al. | |
| 6,255,261 | B1 | 7/2001 | Liesen et al. | |
| 6,323,164 | B1 | 11/2001 | Liesen et al. | |
| 6,331,603 | B1 | 12/2001 | Sivik et al. | |
| 6,610,802 | B2 | 8/2003 | Roos et al. | |
| 2003/0036488 | A1 | 2/2003 | Yuki et al. | |
| 2003/0104955 | A1 | 6/2003 | Yuki et al. | |
| 2004/0077509 | A1 | 4/2004 | Yuki et al. | |
| 2006/0189490 | A1 | 8/2006 | Dardin et al. | |
| 2007/0191239 | A1 | 8/2007 | Matsuoka et al. | |
| 2008/0194443 | A1 | 8/2008 | Stohr et al. | |
| 2012/0135899 | A1 | 5/2012 | Kocsis et al. | |
| 2012/0289444 | A1 * | 11/2012 | Schober et al. | 508/287 |

FOREIGN PATENT DOCUMENTS

| | | |
|---|---|---|
| EP | 0635561 | 1/1995 |
| EP | 2009074 | 12/2008 |
| JP | 10298576 | 11/1998 |
| JP | 2007031666 | 2/2007 |
| JP | 2008-031459 | 2/2008 |
| JP | 200831459 | 2/2008 |
| JP | 2008-088215 | 4/2008 |
| WO | 2006047398 | 5/2006 |
| WO | 2007127615 A2 | 11/2007 |
| WO | 2007127661 A1 | 11/2007 |
| WO | 2007133999 A2 | 11/2007 |
| WO | WO-2007/127663 A2 | 11/2007 |
| WO | 2008058108 A2 | 5/2008 |
| WO | 2010141530 | 12/2010 |

OTHER PUBLICATIONS

Written Opinion from corresponding international Appln. No. PCT/US2010/036990 completed Jul. 28, 2010.

Corresponding International Publication No. WO 2010/141528 A1 & Search Report published Dec. 9, 2010.

JP 2006045277 Abstract, Feb. 16, 2006, Sanyo Chem., Database WPI Week 200618, Thomson Scientific, London, Abstract No. 2006-168205, XP 002594127.

JP 2003147332 Abstract , May 21, 2003, Sanyo Chem., Database WPI Week 200406, Thomson Scientific, London, Abstract No. 2004-046406, XP 002594128.

* cited by examiner

*Primary Examiner* — Prem C Singh
*Assistant Examiner* — Francis C Campanell
(74) *Attorney, Agent, or Firm* — David M. Shold, Esq.; Michael F. Esposito, Esq.

(57) ABSTRACT

A lubricating composition contains an oil of lubricating viscosity and 0.5 to 10 percent by weight of a poly(meth)acrylate viscosity modifier polymer comprising (i) 15 weight percent to 35 weight percent monomer units of methyl(meth)acrylate, (ii) 0 to 10 weight percent monomer units of one or more $C_2$-$C_6$ alkyl(meth)acrylates, (iii) 50 to 85 weight percent monomer units of one or more $C_8$-$C_{30}$ alkyl(meth)acrylates, and (iv) 0 to 10 weight percent monomer units of one or more nitrogen-containing monomers. Such a lubricating composition exhibits a high viscosity index and may impart improved fuel economy to an internal combustion engine.

13 Claims, No Drawings

POLYMETHACRYLATES AS HIGH VI VISCOSITY MODIFIERS

BACKGROUND OF THE INVENTION

The disclosed technology relates to certain polymethacrylates which impart a high viscosity index to lubricants, especially for internal combustion engines.

Acrylic and methacrylic polymers are known for use in lubricant compositions. For example, U.S. Pat. No. 3,397,146, Cupper et al., Aug. 13, 1968, discloses lubricating compositions comprising a mineral oil containing as a viscosity index improver-dispersant additive a polymer of a long chain alkyl acrylate or methacrylate, alkyl acrylate or methacrylate wherein the alkyl has from 1 to 4 carbon atoms, and acrylic or methacrylic acid, wherein the acid moieties of the polymer are neutralized with a 1-hydroxy-alkyl-2-alkyl or alkenyl imidazoline. The short chain alkyl acrylate or methacrylate will usually be from about 3 to about 15 weight percent, based upon weight of monomeric components.

U.S. Pat. No. 6,610,802, Roos et al., Aug. 26, 2003, discloses a process for synthesis of polymer compositions which may be used without further purification as additives in lubricating oils. In certain examples, a monomer mixture of DPMA:MMA of 85:15 is employed, where MMA is methyl methacrylate and DPMA is obtained by the reaction of ®Dobanol 25L (of Shell AG) with methyl methacrylate. The theoretical molecular weight is 20,000 g/mol.

U.S. Pat. No. 4,867,894, Pennewiss et al., Sep. 19, 1989, discloses polymers adaptable to use as pour point lowering additives for petroleum oils, said polymer comprising as comonomers therein (a) from 10 to 30 mole percent of methyl methacrylate, (b) from 10 to 70 mole percent of alkyl methacrylates having linear alkyl groups with from 16 to 30 carbon atoms in the alkyl group, (c) from 10 to 80 mole percent of alkyl methacrylates having linear alkyl groups with from 4 to 15 carbon atoms in the alkyl group and/or having branched alkyl groups with from 4 to 45 carbon atoms in the alkyl group, and (d) from 0 to 30 mole percent of a free-radically polymerizable nitrogen-containing monomer having dispersing action.

U.S. Pat. No. 6,331,603, Sivik et al., Dec. 18, 2001, discloses a nitrogen containing copolymer prepared by reacting (A) from about 55 to about 99.9% by weight of one or more alkyl acrylate ester monomers containing from 1 to about 24 carbon atoms in the ester alkyl group, wherein at least about 50 mole % of the esters contain at least 6 carbon atoms in the ester alkyl group, and (B) from about 0.1% to about 45% by weight of at least one (selected) nitrogen containing monomer. In an example, a container is charged with 57.5 parts methyl methacrylate, 12.7 parts butyl methacrylate, 226.5 parts each of $C_{9-11}$ metacrylate [sic] and $C_{12-15}$ methacrylate, 4.22 parts tert-dodecylmercaptan and 164.4 parts 85 neural paraffinic oil, followed by subsequent addition of VAZO-67 and 11.7! [sic] parts N-(-3-(dimethylamino)propyl)methacrylamide.

Related thereto is U.S. Pat. No. 6,969,068, Bryant et al., Oct. 19, 1999. It discloses a polymethacrylate ester based dispersant-viscosity modifier comprising units derived from (A) about 5% to about 75% by weight of alkyl acrylate ester monomers containing from 1 to 11 carbon atoms in the alkyl group; (B) about 25% to about 95% by weight of alkyl acrylate ester monomers containing from 12 to about 24 carbon atoms in the alkyl group; and (C) about 0.2% to about 20% by weight of a nitrogen containing monomer.

U.S. Pat. No. 6,124,249, Seebauer et al., Sep. 26, 2000, discloses viscosity improvers for lubricating oil compositions. A copolymer may comprise units derived from (a) methacrylic acid esters containing from about 13 to about 19 carbon atoms in the ester group, (b) certain methacrylic acid esters containing from 7 to about 12 carbon atoms in the ester group, and (c) at least one monomer selected from the group consisting of methacrylic acid esters containing from 2 to about 8 carbon atoms in the ester group, vinyl aromatic compounds, and nitrogen-containing vinyl monomers. Monomer (c) may be methyl methacrylate. When groups derived from monomer (c) are present, they comprise from about 0.2 to about 60 mole %, or 1 to about 25 mole %, of the units present in the polymer. In an example, a polymer is prepared from 280 parts $C_{12-15}$ methacrylate, 80 parts 2-ethylhexyl methacrylate, and 40 parts methyl methacrylate.

The disclosed technology, therefore, addresses the problem of imparting a high viscosity index to a lubricant, thereby leading, in certain embodiments, to lubricants which provide improved fuel economy.

SUMMARY OF THE INVENTION

The disclosed technology provides a lubricating composition comprising an oil of lubricating viscosity and 0.5 to 10 percent by weight of a poly(meth)acrylate viscosity modifier polymer comprising (i) greater than 15 weight percent to 45 weight percent monomer units of methyl(meth)acrylate, (ii) 0 to 10 weight percent monomer units of one or more $C_2$-$C_6$ alkyl(meth)acrylates, (iii) 50 to less than 85 weight percent monomer units of one or more $C_8$-$C_{30}$ alkyl(meth)acrylates, and (iv) 0 to 10 weight percent monomer units of one or more nitrogen-containing monomers.

In another embodiment, the disclosed technology provides a lubricating composition comprising an oil of lubricating viscosity and 0.5 to 30 percent by weight of a poly(meth) acrylate viscosity modifier polymer comprising (i) 15 weight percent to 35 weight percent monomer units of methyl(meth) acrylate, (ii) 0 to 10 weight percent monomer units of one or more $C_2$-$C_6$ alkyl(meth)acrylates, (iii) 50 to 85 weight percent monomer units of one or more $C_8$-$C_{30}$ alkyl(meth)acrylates, and (iv) 0 to 10 weight percent monomer units of one or more dispersant monomers.

The disclosed technology also provides a method for lubricating an internal combustion engine comprising supplying thereto such a lubricating composition.

DETAILED DESCRIPTION OF THE INVENTION

Various preferred features and embodiments will be described below by way of non-limiting illustration.

Oil of Lubricating Viscosity

The lubricating composition comprises an oil of lubricating viscosity. Such oils include natural and synthetic oils, oil derived from hydrocracking, hydrogenation, and hydrofinishing, unrefined, refined, and re-refined oils and mixtures thereof.

Natural oils useful in making the inventive lubricants include animal oils, vegetable oils (e.g., castor oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerized, oligomerized, or interpolymerized olefins (e.g., polybutylenes, polypropylenes, propyleneisobutylene copolymers); poly(1-hexenes), poly(1-octenes), trimers or oligomers of 1-decene, e.g., poly(1-decenes), such materials being often referred to as poly α-olefins, and mixtures thereof; alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Other synthetic lubricating oils include polyol esters (such as Priolube® 3970), diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

Unrefined oils are those obtained directly from a natural or synthetic source generally without (or with little) further purification treatment. Refined oils are similar to the unrefined oils except they have been further treated in one or more purification steps to improve one or more properties. Purification techniques are known in the art and include solvent extraction, secondary distillation, acid or base extraction, filtration, percolation and the like. Re-refined oils are also known as reclaimed or reprocessed oils, and are obtained by processes similar to those used to obtain refined oils and often are additionally processed by techniques directed to removal of spent additives and oil breakdown products.

Oils of lubricating viscosity may also be defined as specified in the American Petroleum Institute (API) Base Oil Interchangeability Guidelines. The five base oil groups are as follows: Group I (sulfur content >0.03 wt %, and/or <90 wt % saturates, viscosity index 80-120); Group II (sulfur content <0.03 wt %, and >90 wt % saturates, viscosity index 80-120); Group III (sulfur content <0.03 wt %, and >90 wt % saturates, viscosity index >120); Group IV (all polyalphaolefins (PAOs)); and Group V (all others not included in Groups I, II, III, or IV).

In certain embodiments, the oil of lubricating viscosity may comprise an oil having a viscosity index of at least 120 or, in certain embodiments, at least 110, 115, 120, 130 or 140. That is to say, the overall oil which is present in the formulation (including, in certain embodiments, the diluent oil components that may be contributed by certain additives), may have a viscosity index of this magnitude, even though the overall oil component may be prepared by blending various amounts of other oils including some oils that, individually, may have a lower viscosity index. Oils having such viscosity indices are typically of API Group III oils. Group III oils are also required, by their definition, to be mineral-based oils having a sulfur content of up to 0.03% and saturates of at least 90%. These additional features may be present, in certain embodiments, for the oils of the present invention, but in certain embodiments the oil may have, for instance, a greater sulfur content or a lower saturates content, provided that the viscosity index is as specified. Minor amounts (e.g., less than 50% by weight or less than 20 or 10 or 5 or 1 percent, with lower limits such as 0, 1, 2, 5, or 10 percent) of non-mineral oils, such as Group IV and Group V may also be present so long as overall the oil has a viscosity index of as specified. The viscosity index is that of the oil component itself, apart from the presence of any additives and apart from the presence of the viscosity modifier polymer.

Particularly useful oils may also have a kinematic viscosity at 100° C. of less than 7.0 $mm^2 s^{-1}$, for instance 2 to less than 6 or to less than 5 $mm^2 s^{-1}$ or 3 to 5 or 3 to 4.5 $mm^2 s^{-1}$. Suitable oils include those designated as 100 Neutral (100N) oils for lower viscosities or 150 N for somewhat higher viscosity. It is desirable that the oil has a suitably low viscosity, especially at lower temperatures, in order to minimize viscosity-caused performance losses and thereby maximize fuel economy in an engine. For this reason, a high viscosity index (ASTM D 2270) as described above is desirable. These are base oils suitable for preparing a complete formulation (including the viscosity modifier and other additives) having a dynamic viscosity at 150° C. under high shear conditions (ASTM D 4683) of less than 2.9 mPa-s (cP), or less than 2.5 or 1.8 to 2.3 mPa-s. Oils having these viscosity parameters are well known and are commercially available. In particular, refined oils such as solvent extracted oils will typically have higher (better) viscosity indices because low VI components such as aromatic or naphthenic components have been removed to a greater or lesser extent, leaving predominantly the higher VI paraffinic components. Refining will also typically remove various other undesirable materials such as sulfur.

The amount of the oil of lubricating viscosity present is typically the balance remaining after subtracting from 100 wt % the sum of the amount of the viscosity modifier and the other performance additives.

The lubricating composition may be in the form of a concentrate and/or a fully formulated lubricant. If the present lubricating composition (comprising the viscosity modifier polymer) is in the form of a concentrate (which may be combined with additional oil to form, in whole or in part, a finished lubricant), the ratio of the of the polymer to the oil of lubricating viscosity and/or to diluent oil include the ranges of 1:99 to 99:1 by weight, or 80:20 to 10:90 by weight.

The lubricants of the present technology will also contain a poly-(meth)acrylate viscosity modifier polymer. As used herein, the expressions "(meth)acrylate" and the like are understood to refer to either acrylate or methacrylate or mixtures thereof (or the corresponding acid, amide, etc., as the context may indicate). The viscosity modifier polymer will comprise 15 weight percent to 35 weight percent, or alternatively greater than 15 weight percent to 45 weight percent monomer units of methyl(meth)acrylate, that is, polymerized units derived from methyl acrylate or methacrylate monomers, 0 to 10 weight percent monomer units of one or more $C_2$ to $C_6$ alkyl(meth)acrylates, 50 to 85 weight percent, or alternatively 15 to less than 85 weight percent, monomer units of one or more $C_8$-$C_{30}$ (e.g., $C_{12-15}$) alkyl(meth)acrylates, and 0.5 to 10 weight percent monomer units of one or more dispersant monomers. The alkyl groups may be linear or branched, saturated or unsaturated. In certain embodiments some or all of the alkyl groups are linear and saturated. Other monomer units may also be present.

The methyl(meth)acrylate units within the polymer may be methyl methacrylate and may be present in amounts of greater than 15 to 45 weight percent of the polymer, or 15 to 35, or 16 to 35, or 17 to 40, or 18 to 35, or 18 to 30, or 19 to 25, or 20 to 25, or 19 to 22 weight percent of the polymer. The $C_2$ to $C_6$ alkyl(meth)acrylate units may be butyl methacrylate units. The $C_2$ to $C_6$ alkyl(meth)acrylate units may be present at 0 to 10 weight percent of the polymer or 0.5 to 5 percent or 0.8 to 2 or 0 to 2 percent. The $C_8$ to $C_{30}$ alkyl(meth)acrylate units may be $C_{10}$ to $C_{1-6}$ alkyl methacrylates or mixtures thereof, such $C_{12-15}$ alkyl methacrylates or lauryl (i.e., n-dodecyl)methacrylate. Such units may be present at 50 to less than 85 weight percent of the polymer, or 60 to less than 85, or 65 to 85, or 70 to 80, or 70 to 80, or 75 to 80, weight percent of the polymer. The upper amount of the $C_8$ to $C_{30}$ alkyl(meth)acrylate may also be the amount obtained by subtracting from 100 percent the amount of the other monomers for a given polymer, such as 80.5 percent or 81 percent or 84 percent or 85 percent.

The viscosity modifier polymer may also contain 0 to 10 weight percent monomer units of one or more dispersant monomers, which may be nitrogen-containing monomers. Such monomers will typically be of the type used to impart dispersant character to the polymer, which then is sometimes referred to as a dispersant viscosity modifier. The nitrogen-containing monomers may be (meth)acrylic monomers such as methacrylates or methacrylamides. That is, the linkage of the nitrogen-containing moiety to the acrylic moiety may be through a nitrogen atom or alternatively an oxygen atom, in which case the nitrogen of the monomer will be located elsewhere in the monomer unit. The nitrogen-containing monomer may also be other than a (meth)acrylic monomer, such as vinyl-substituted nitrogen heterocyclic monomers and vinyl substituted amines. Nitrogen-containing monomers are well known, examples being disclosed, for instance, in U.S. Pat. No. 6,331,603. Among the suitable monomers are dialkylaminoalkyl acrylates, dialkylaminoalkyl methacrylates, dialkylaminoalkyl acrylamides, dialkylaminoalkyl methacrylamides, N-tertiary alkyl acrylamides, and N-tertiary alkyl methacrylamides, where the alkyl group or aminoalkyl groups may contain, independently, 1 to 8 carbon atoms. The nitrogen-containing monomer may be, for instance, t-butyl acrylamide, N-(3-(dimethylamino)propyl) methacrylamide, dimethylaminopropyl methacrylamide, dimethylaminoethyl methacrylamide, N-vinyl pyrrolidone, N-vinylimidazole, or N-vinyl caprolactam. It may also be a (meth)acrylamide based on any of the aromatic amines disclosed in WO2005/087821 including 4-phenylazoaniline, 4-aminodiphenylamine, 2-aminobenzimidazole, 3-nitroaniline, 4-(4-nitrophenylazo)aniline, N-(4-amino-5-methoxy-2-methyl-phenyl)-benzamide, N-(4-amino-2,5-dimethoxy-phenyl)-benzamide, N-(4-amino-2,5-diethoxy-phenyl)-benzamide, N-(4-amino-phenyl)-benzamide, 4-amino-2-hydroxy-benzoic acid phenyl ester, and N,N-dimethyl-phenylenediamine.

Alternatively, the dispersant monomer may be described as a monomer containing a pendent hydrocarbyl group substituted with a nitrogen- or oxygen-containing group, such as an amino group or a hydroxy group. Examples of dispersant monomers with an oxygen-containing group are hydroxyalkyl(meth)acrylates such as hydroxyethyl methacrylate.

The amount of the nitrogen-containing monomer, if present, is generally 0.5 to 10 weight percent of the polymer, and in other embodiments 1 to 8, or 2 to 6, or 3 to 4 percent by weight of the polymer. The dispersant monomer may also be employed to impart improved viscosity index properties (that is, a "viscosity index boost") to the polymer and to the lubricant containing the polymer, as well as imparting dispersancy, without sacrificing the oil-solubility properties of the polymer.

The weight average molecular weight, Mw, of the polymer may be 20,000 to 1,000,000 or 100,000 to 500,000 or 200,000 to 500,000, or 50,000 to 500,000, or 250,000 to 450,000 or 200,000 to 450,000, or at least 200,000, or 300,000 to 1,000,000.

In one embodiment the lubricant composition may contain 1 to 5 percent by weight of a viscosity modifier polymer comprising 15 to 25 weight percent methyl methacrylate monomer units, 60 to 84 weight percent $C_{12-15}$ alkyl methacrylate monomer units, and 1 to 8 weight percent dimethylaminoethyl methacrylate monomer units. Monomer units of $C_{2-4}$ alkyl(meth)acrylates may optionally be absent. The polymer may have a weight average molecular weight of 200,000 to 500,000.

In one embodiment the polymer may be a polymethacrylate polymer comprising greater than 15 to 45 weight percent monomer units of methyl methacrylate, 0 to 10 weight percent monomer units of one or more $C_2$-$C_6$ alkyl methacrylates, 50 to less than 83 weight percent monomer units of one or more $C_{10}$-$C_{16}$ alkyl methacrylates, and 2 to 8 weight percent monomer units of one or more nitrogen-containing methacrylic monomers, said polymer having a weight average molecular weight of about 50,000 to about 500,000 or 200,000 to 500,000.

In another embodiment the polymer comprises 19 to 30 weight percent units of methyl methacrylate, 0.5 to 2 weight percent units of butyl methacrylate, 70 to 80 weight percent $C_{12-15}$ alkyl methacrylate, and 2 to 4 weight percent units of dimethylaminoethyl methacrylamide or of dimethylaminopropyl methacrylamide, having a weight average molecular weight of 300,000 to 400,000.

In another embodiment the polymer comprises 18 to 30 weight percent methyl methacrylate monomer units; 0.5 to 5 weight percent butyl methacrylate monomer units; 60 to 80.5 weight percent lauryl methacrylate monomer units; and 1 to 8 weight percent dimethylaminopropyl methacrylate monomer units.

In yet another embodiment the polymer comprises 18 to 30 weight percent methyl methacrylate monomer units; 60 to 81 weight percent lauryl methacrylate monomer units; and 1 to 8 weight percent dimethylaminoethyl methacrylate monomer units. In such an embodiment the polymer may contain no or substantially no butyl acrylate units.

The viscosity modifier may be prepared by free radical polymerization of the (meth)acrylate monomers, by known methods. These methods include conventional free radical polymerization as well as various known methods of controlled polymerization such as atom transfer radical polymerization (ATRP) and reversible addition-fragmentation chain transfer (RAFT).

In certain embodiments, the polymer is free from di- or multi-functional monomers. In certain embodiments the polymer is substantially linear.

The amount of the viscosity modifier polymer in the lubricant composition may be 0.5 to 10 weight percent of the composition (presented on an oil-free basis). Alternative amounts include 1 to 5 or 1.5 to 2.5 percent by weight. Such an amount may be an amount to provide, together with the oil of lubricating viscosity, a formulated lubricant having a high-temperature, high-shear viscosity (ASTM D 4683) of less than 2.9 mPa-s (cP) at 150° C., or 2.0 to 2.8 or 2.1 to 2.7 mPa-s. Such materials may correspond to a lubricant formulation having a viscosity grade of 0W-20 or 0W-30 or 0W-40.

Other Performance Additives

The composition optionally comprises other performance additives typically employed in lubricants, e.g., lubricants for internal combustion engines. The other performance additives may comprise at least one of metal deactivators, viscosity modifiers (other than the viscosity modifier described above), detergents, friction modifiers, antiwear agents, phosphorus-containing zinc salts, corrosion inhibitors, dispersants, dispersant viscosity modifiers, extreme pressure agents, antioxidants, foam inhibitors (anti-foam agents), demulsifiers, pour point depressants, seal swelling agents and mixtures thereof. Typically, fully-formulated lubricating oil will contain one or more of these performance additives.

In one embodiment the lubricating composition further comprises at least one of an antioxidant, an overbased detergent, a dispersant such as a succinimide dispersant, or mixtures thereof. In one embodiment the lubricating composition comprising an ashless antiwear agent or a hydroxy carboxylic compound, and a phosphorus-containing antiwear agent.

Detergents

The lubricant composition optionally comprises a neutral or overbased detergent. Suitable detergent substrates include phenates, sulfur containing phenates, sulfonates, salixarates, salicylates, carboxylic acids, phosphorus acids, mono- and/or di-thiophosphoric acids, alkyl phenols, sulfur coupled alkyl phenol compounds, and saligenins. Various overbased detergents and their methods of preparation are described in greater detail in numerous patent publications, including WO2004/096957 and references cited therein. The detergent substrate is typically salted with a metal such as calcium, magnesium, potassium, sodium, or mixtures thereof, and may be further treated with an acidic material such as carbon dioxide to aid in incorporation of base, thereby forming a carbonated material. Examples include overbased carbonated calcium sulfonate detergents and overbased carbonated sodium detergents. The overbased detergents may have a total base number of 100 to 500 or 250 to 450 or 300 to 400, as calculated on an oil-containing basis (e.g., as the commercial materials containing about 50% diluent oil). The detergent may be present at 0 wt % to 10 wt %, or 0.1 wt % to 8 wt %, or 0.4 wt % to 4 wt %, or 0.5 to 2 wt % or 0.6 to 1 wt % (oil free basis).

Dispersants

Dispersants are often known as ashless-type dispersants because, prior to mixing in a lubricating oil composition, they do not contain ash-forming metals and they do not normally contribute any ash forming metals when added to a lubricant and polymeric dispersants. Ashless type dispersants are characterized by a polar group attached to a relatively high molecular weight hydrocarbon chain. Typical ashless dispersants include N-substituted long chain alkenyl succinimides. Examples of N-substituted long chain alkenyl succinimides include polyisobutylene succinimide derived from isobutene with number average molecular weight in the range 350 to 5000, or 500 to 3000. Succinimide dispersants and their preparation are disclosed, for instance in U.S. Pat. No. 3,172,892 or U.S. Pat. No. 4,234,435 or in EP 0355895. Succinimide dispersants are typically the imide formed from a polyamine, typically a poly(ethyleneamine).

In one embodiment the invention comprises a polyisobutylene succinimide dispersant derived from polyisobutylene with number average molecular weight in the range 350 to 5000, or 500 to 3000. The polyisobutylene succinimide may be used alone or in combination with other dispersants.

Another class of ashless dispersant is Mannich bases. Mannich dispersants are the reaction products of alkyl phenols with aldehydes (especially formaldehyde) and amines (especially polyalkylene polyamines). The alkyl group typically contains at least 30 carbon atoms.

The dispersants may also be post-treated by conventional methods by a reaction with any of a variety of agents. Among these are boron, urea, thiourea, dimercaptothiadiazoles, carbon disulfide, aldehydes, ketones, carboxylic acids, hydrocarbon-substituted succinic anhydrides, maleic anhydride, nitriles, epoxides, and phosphorus compounds.

The dispersant may be present at 0 wt % to 20 wt %, or 0.1 wt % to 15 wt %, or 0.1 wt % to 10 wt %, or 1 wt % to 6 wt % of the lubricating composition.

Antioxidants

Antioxidant compounds are known and include for example, sulfurized olefins (typically sulfurized 4-carbobutoxy cyclohexene or olefin sulfide), alkylated diphenylamines (e.g., nonyl diphenylamine, typically di-nonyl diphenylamine, octyl diphenylamine, di-octyl diphenylamine), hindered phenols, or mixtures thereof. Antioxidant compounds may be used alone or in combination. The antioxidant may be present in ranges 0 wt % to 20 wt %, or 0.1 wt % to 10 wt %, or 1 wt % to 5 wt %, of the lubricating composition.

The hindered phenol antioxidant may contain a secondary butyl and/or a tertiary butyl group as a sterically hindering group. The phenol group may be substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant is an ester and may include, e.g., Irganox™ L-135 from Ciba or an addition product derived from 2,6-di-tert-butylphenol and an alkyl acrylate, wherein the alkyl group may contain 1 to 18, or 2 to 12, or 2 to 8, or 2 to 6, or 4 carbon atoms. A more detailed description of suitable ester-containing hindered phenol antioxidant chemistry is found in U.S. Pat. No. 6,559,105. In one embodiment the lubricant does not contain (or contains reduced amounts of) phenolic antioxidants, which are believed to sometimes contain environmentally objectionable byproducts.

Viscosity Modifiers

Additional viscosity modifiers include hydrogenated copolymers of styrene-butadiene, ethylene-propylene copolymers, polyisobutenes, hydrogenated styrene-isoprene polymers, hydrogenated isoprene polymers, polymethacrylates, polyacrylates, poly(alkyl styrenes), hydrogenated alkenyl aryl conjugated diene copolymers, polyolefins, esters of maleic anhydride-styrene copolymers, or esters of (alpha-olefin maleic anhydride) copolymers. Dispersant viscosity modifiers (often referred to as DVMs), include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine. The total amount of the optional additional viscosity modifier and/or dispersant viscosity modifier may be 0 wt % to 20 wt %, 0.1 wt % to 15 wt %, or 0.1 wt % to 10 wt %, of the lubricating composition.

Antiwear Agents, Including Phosphorus-Containing Zinc Salts

The lubricant composition optionally further comprises at least one antiwear agent. Examples of suitable antiwear agents include phosphate esters, sulfurized olefins, sulfur-containing anti-wear additives including metal dihydrocarbyldithiophosphates (such as zinc dialkyldithiophosphates), thio-carbamate-containing compounds including, thiocarbamate esters, alkylene-coupled thiocarbamates, and bis(S-alkyldithiocarbamyl)disulfides, and monoesters of polyols and acids such as glycerol monooleate. In one embodiment the lubricating composition is free of zinc dihydrocarbyl dithiophosphate. In one embodiment the lubricating composition further includes zinc dihydrocarbyl dithiophosphate. The antiwear agent may be present in ranges including 0 wt % to 15 wt %, or 0 wt % to 10 wt %, or 0.05 wt % to 5 wt %, or 0.1 wt % to 3 wt % of the lubricating composition.

Friction Modifiers

In one embodiment the further comprises a friction modifier, or mixtures thereof. Typically the friction modifier may be present in ranges including 0 wt % to 10 wt %, or 0.05 wt % to 8 wt %, or 0.1 wt % to 4 wt %. Examples of suitable friction modifiers include long chain fatty acid derivatives of amines, esters, or epoxides; fatty imidazolines (that is, long chain fatty amides, long chain fatty esters, long chain fatty epoxide derivatives, and long chain fatty imidazolines); and amine salts of alkylphosphoric acids. Friction modifiers may also encompass materials such as sulfurized fatty compounds and olefins, triglycerides (e.g. sunflower oil) or monoester of a polyol and an aliphatic carboxylic acid.

Another friction modifier may be a hydroxy carboxylic compound. The hydroxy carboxylic compound may have the general formula of, or may be represented by, the structure

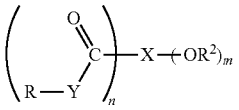

where n and m are independently integers of 1 to 5; X is an aliphatic or alicyclic group, or an aliphatic or alicyclic group containing an oxygen atom in the carbon chain, or a substituted group of the foregoing types, said group containing up to 6 carbon atoms and having n+m available points of attachment; each Y is independently —O—, >NH, or >$NR^1$ or two Ys together representing the nitrogen of an imide structure R—N< formed between two carbonyl groups; each R and $R^1$ are independently hydrogen or a hydrocarbyl group, provided that at least one R or $R^1$ group is a hydrocarbyl group; each $R^2$ is independently hydrogen, a hydrocarbyl group, or an acyl group, further provided that at least one —$OR^2$ group is located on a carbon atom of X that is α or β to at least one of the —C(O)—Y—R groups. Since Y may be oxygen or nitrogen (that is, >NH or $NR^1$), the material will be an ester an amide or an imide, or mixtures thereof. The hydrocarbyl group or groups represented by R and $R^1$ will typically contain 1 to 150 carbon atoms or, in alternative embodiments, 4 to 30 carbon atoms or 6 to 20 or 10 to 20 or 11 to 18 or 8 to 10 carbon atoms.

In certain embodiments at least one of n and m is greater than 1, that is, 2 to 5 or 2 to 4 or 2 to 3 and the other may be 1 or any of the aforementioned ranges. When n and m are both 1, a suitable structure is that based on glycolic acid, HO—$CH_2$—$CO_2H$, that is, where X is the —$CH_2$— group. The corresponding acid where X is —$CH_2CH_2$— is lactic acid, which may also be useful. Such materials may form the corresponding esters and amides. Examples of acids where at least one of n or m is greater than 1 include malic acid, tartaric acid, and citric acid. Those materials for which n is 2 or greater may also exist in the imide form.

The di-esters, di-amides, and ester-amide compounds may be prepared by reacting a dicarboxylic acid (such as tartaric acid), with an amine or alcohol, optionally in the presence of a known esterification catalyst. Examples include esters, amides, and imides of tartaric acid, citric acid, malic acid, and glycolic acid, and in certain embodiments, tartrates, tartramides, and tartrimides. In particular, oleyl tartrimide has been found to be useful, as well as $C_{12-16}$ alkyl tartrate diesters. $C_{12-16}$ alkyl tartrate diesters may contain a mixture of alkyl groups containing 12, 13, 14, and 15 carbon atoms or combinations thereof. Alkyl groups of 16 carbon atoms may or may not be present in appreciable amounts. The $C_{12-16}$ alkyl groups may be either linear or branched, as may also be any of the R or $R^1$ groups. Among the alcohols which may be reacted are monohydric or polyhydric, linear or branched alcohols. Examples of suitable branched alcohols include 2-ethylhexanol, isotridecanol, Guerbet alcohols, and mixtures thereof. In one embodiment, a monohydric alcohol contains 5 to 20 carbon atoms. In one embodiment a polyhydric alcohol is used in a mixture along with a monohydric alcohol.

Among the suitable X groups, forming, as it were, the core of the molecule, may be —$CH_2$—, —$CH_2CH_2$—, >CHCH< (where "<" and ">" represent two bonds to the carbon atoms), >$CHCH_2$—, and >$C(CH_2—)_2$, where the bonds are occupied by the appropriate —C(O)YR and —$OR^2$ groups. In an alternative embodiment, the "core" may have a structure reminiscent of a monosaccharide, such as

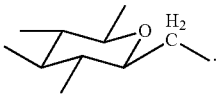

The —$OR^2$ groups in the above structures may similarly be, independently, hydroxy groups, where $R^2$ is hydrogen, or hydrocarbyl groups of the same type as R or $R^1$ or having, e.g., 1 to 4 carbon atoms, or acyl groups including acyl groups derived from lower carboxylic acids such as those having 1 to 6 carbon atoms such as acetic acid, propionic acid, or butyric acid. In certain embodiments, all the $R^2$ groups are hydrogen. In certain embodiments, at least one of the —$OR^2$ groups in the molecule is be located on a carbon atom that is at a or β position to one of the —C(O)—Y—R groups.

The same chemical structures have also been written in a different format in recent patent applications such as WO2008/147700. The ashless antiwear agent of the present technology may be borated or not borated. In one embodiment ashless antiwear agent is derived from tartaric acid (in any of its isomers). A detailed description of methods for preparing suitable tartrimides (by reacting tartaric acid with a primary amine) is disclosed in U.S. Pat. No. 4,237,022; see, for instance, columns 4 and 5. U.S. Patent Application 2005/198894 discloses suitable hydroxycarboxylic acid compounds and methods of preparing the same. Canadian Patent 1183125; US Patent Publication numbers 2006/0183647 and 2006/0079413; PCT application WO2008/067259; and British Patent 2 105 743 A, all disclose examples of suitable tartaric acid derivatives.

This hydroxy carboxylic compound may also serve as an antiwear agent (although not all friction modifiers will necessarily be antiwear agents, and vice versa). It may also act as an antioxidant or impart other useful functionality. The hydroxy carboxylic compound may be present at 0.01 wt % to 2 wt %, or 0.05 to 1.5 wt %, or 0.1 to 1 wt % or 0.2 to 0.6 wt % of the lubricating composition.

Other performance additives include corrosion inhibitors such as include those described in paragraphs 5 to 8 of US Application US05/038319, octylamine octanoate, and condensation products of dodecenyl succinic acid or anhydride and a fatty acid such as oleic acid with a polyamine, or commercial corrosion inhibitors sold under the trade name Synalox® corrosion inhibitors. Other additives include metal deactivators including derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors, including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides. Extreme Pressure (EP) agents may also be present, including sulfur- and chlorosulfur-containing EP agents, chlorinated hydrocarbon EP agents, and phosphorus EP agents.

Oil-Soluble Molybdenum Compound

The lubricants of the present technology may contain, or may exclude, molybdenum in the form of an oil-soluble molybdenum compound. The amount of molybdenum may be less than 500 parts per million by weight of the lubricant composition, that is, 0 to 500 ppm, such as less than 400 or 300 or 200 or 100 or 50 or 10 or 1 parts per million. A lower limit on the amount of molybdenum may be 0 or 0.01 or 0.1 or 1 parts per million. In other embodiments, a lower limit on the amount of molybdenum may be 10 or 50 or 100 parts per million. Suitable amounts, if molybdenum is present, may thus include 10 to 500 parts per million, or 50 to 400, or 100 to 300 parts per million In certain embodiments, the formulation is substantially free from molybdenum. Typically, oil-soluble molybdenum compounds include molybdenum dithio-carbamates, molybdenum dialkyldithiophosphates, amine salts of molybdenum compounds, molybdenum xanthates, molybdenum sulfides, molybdenum carboxylates, molybdenum alkoxides, or mixtures thereof.

Oil-Soluble Boron Compound

The lubricants of the present technology may contain, or may exclude, boron in the form of an oil-soluble boron compound. The amount of boron may be less than 200 parts per million by weight of the lubricant composition, such as less than 100 or 50 or 10 or 1 parts per million. A lower limit on the amount of boron may be 0 or 0.01 or 0.1 or 1 parts per million. In certain embodiments, the formulation is substantially free from boron and may be free or substantially free of borated dispersants (as described below). Other types of compounds that may contribute boron to the composition may include borated ashless antiwear agents as described above, borated detergents, boric acid, and borate esters such as borated epoxides.

INDUSTRIAL APPLICATION

The lubricating composition may be used in a range of surfaces typically found in mechanical devices, including ferrous and aluminum-alloy surfaces. The mechanical devices include internal combustion engines, gearboxes, automatic transmissions, hydraulic devices, and turbines. Typically the lubricating composition may be an engine oil, a gear oil, an automatic transmission oil, a hydraulic fluid, a turbine oil, a metal working fluid, or a circulating oil. In one embodiment the mechanical device is an internal combustion engine (gasoline or diesel fueled, 2-stroke or 4-stroke, automotive, truck, off-road, or marine), which may be lubricated by supplying thereto a lubricant composition as described herein.

The lubricant composition for an internal combustion engine may be suitable for any engine lubricant irrespective of the sulfur, phosphorus or sulfated ash (ASTM D-874) content. The sulfur content of the engine oil lubricant may be 1 wt % or less, or 0.8 wt % or less, or 0.5 wt % or less, or 0.3 wt % or less. In one embodiment the sulfur content may be in the range of 0.001 wt % to 0.5 wt %, or 0.01 wt % to 0.3 wt %. The phosphorus content may be 0.2 wt % or less, or 0.1 wt % or less, or 0.085 wt % or less, or even 0.06 wt or less, 0.055 wt % or less, or 0.05 wt % or less. In one embodiment the phosphorus content may be 100 ppm to 1000 ppm, or 325 ppm to 700 ppm. The total sulfated ash content may be 2 wt % or less, or 1.5 wt % or less, or 1.1 wt % or less, or 1 wt % or less, or 0.8 wt % or less, or 0.5 wt % or less. In one embodiment the sulfated ash content may be 0.05 wt % to 0.9 wt %, or 0.1 wt % or 0.2 wt % to 0.45 wt %.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this technology, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this technology, contain other than carbon in a ring or chain otherwise composed of carbon atoms and encompass substituents as pyridyl, furyl, thienyl and imidazolyl. Heteroatoms include sulfur, oxygen, and nitrogen. In general, no more than two, preferably no more than one, non-hydrocarbon substituent will be present for every ten carbon atoms in the hydrocarbyl group; typically, there will be no non-hydrocarbon substituents in the hydrocarbyl group.

EXAMPLES

The following examples provide illustrations of the invention. These examples are non-exhaustive and are not intended to limit the scope of the invention.

Preparative Example 1

Polymer synthesis. Into a 5-L flask is charged 1152.5 g $C_{12-15}$ alkyl methacrylate, 296 g methyl methacrylate, 3016 g oil (S oil "Ultra 3", a "group II+" oil) 0.525 g Trigonox 21™ initiator, and 0.525 g n-dodecyl mercaptan. The contents are agitated to mix. One-third of this mixture is transferred to a 12-L round-bottom flask equipped with mechanical stirrer, condenser, thermocouple, addition funnel, and nitrogen inlet, the flask containing 52.5 g dimethylaminoethyl methacrylate. The flask is purged with nitrogen at 60 L/hr (2 SCFH) for 2 hours prior to charge of chemicals. The reaction mixture is heated to 110° C. (while still under nitrogen flow) and an exothermic reaction ensues, whereby the temperature of the reaction mixture peaks at 120° C. The remainder of the monomer mixture is added over 1.5 hours via the addition funnel while maintaining the reaction temperature at 110±5° C. After the addition is complete, the mixture is stirred for an additional 1 hour at 110° C. An additional 1.4 g Trigonox 21™ is added to the mixture, along with 600 g oil, in four portions, over the next 4 hours, and stirring is continued for an hour thereafter. Luperox P™, an additional initiator, 2.4 g in 25 g oil, is added and the mixture is stirred for an additional 2 hours. Finally, 1773 g of additional diluent oil is added and the mixture is allowed to stir at 110° C. for one additional hour. The product, containing about 66% oil, is used without purification.

Preparative Example 2

Preparative Example 1 is substantially repeated, except the following amounts of monomers are used (relative weight percents): 76.1% $C_{12-15}$ alkyl methacrylate, 19.5% methyl methacrylate, 1.0% butyl methacrylate, and 3.43% dimethylaminopropyl methacrylate. The product has a weight average molecular weight of 310,000 and contains about 67% oil.

Preparative Example 3

Preparative Example 1 is substantially repeated, except that the following amounts of monomers are used (relative weight percents): 76.83% $C_{12-15}$ alkyl methacrylate, 19.67% methyl methacrylate, and 3.5% dimethylaminoethyl methacrylate. The product has a weight average molecular weight of 368,000 and contains about 64% oil.

The materials of Preparative Examples 2 and 3 are evaluated in a lubricant formulation suitable for an internal combustion engine. The lubricant contains, in a mineral oil (100 N), 1.53 percent overbased calcium sulfonate detergents (containing about 42% oil), 4.1 percent of a succinimide dispersant (containing about 47% oil), 1.79% antioxidants, 0.56% zinc dialkyldithio-phosphate (10% oil), 0.5% ashless friction modifier based on a $C_{12-14}$ alkyl tartrate, and lesser amounts of pour point depressant and foam inhibitor. To the lubricant formulation is added the VI improver from Preparative Example 2 or Preparative Example 3, or, for reference, a commercially available viscosity modifier, Viscoplex™ 6-850 (believed to be a copolymer of 90% lauryl methacrylate, 8% methyl methacrylate, and 2% N-vinylpyrrolidone, supplied containing 70% oil).

Lubricant formulations, containing a viscosity modifier as indicated, are evaluated for kinematic viscosity at 40 and 100° C. and for viscosity index, per ASTM D 2270. They are also evaluated by the high temperature high shear test of ASTM D 4683 and the cold crank shear test of ASTM D 5293 (−35° C.). Results are shown in the table below (amounts of VI improver include diluent oil, followed by amount of neat polymer in parentheses):

| | | Ref. Ex. 1 | Ex. 2 | Ex. 3 |
|---|---|---|---|---|
| VI Improver, % (% neat polymer) | Viscoplex ™ 6-860 | 4.3 (~1.8) | | |
| | Copolymer of Prep Ex. 2 | | 5.6 (~1.85) | |
| | Copolymer of Prep Ex. 3 | | | 5.4 (~1.8) |
| D2270 | K.V., 40° C. ($mm^2/s$) | 38.6 | 37.2 | 36.4 |
| | K.V., 100° C. ($mm^2/s$) | 8.56 | 8.74 | 8.73 |
| | Viscosity Index | 209 | 225 | 232 |
| D4683 | HTHS | 2.52 | 2.63 | 2.51 |
| D5293 | CCS, −35° C., mPa-s (cPs) | 5341 | 5661 | 4879 |

Inclusion of high levels of methyl methacrylate along with high levels of N-containing monomer in the polymers of the present technology permits the preparation of poly(meth) acrylate viscosity modifiers that provide a significant improvement in viscosity index without sacrificing low temperature viscosity. Higher VI lubricants provide better high temperature durability (by maintaining film strength) while at the same time providing good low-temperature fluidity, which can improve fuel economy at engine start-up. It is well known to those skilled in the art that increasing the content of short-chain monomers (such as methacrylic acid), leading to polymers with poor oil solubility, especially in high molecular weight polymers, will hurt the low temperature performance of formulations containing those polymers. The present technology provides a way to obtain high viscosity index formulations which still have good low temperature performance.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

Each of the documents referred to above is incorporated herein by reference. The mention of any document is not an admission that such document qualifies as prior art or constitutes the general knowledge of the skilled person in any jurisdiction. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A lubricating composition comprising:

(a) an oil of lubricating viscosity; and (b) about 0.5 to about 5 percent by weight of a poly(meth) acrylate viscosity modifier polymer having a weight average molecular weight of about 200,000 to about 450,000 and consisting essentially of (i) 15 weight percent to about 22 weight percent monomer units of methyl(meth)acrylate, (ii) about 75 to about 81 weight percent monomer units of one or more $C_{10}$-$C_{16}$ alkyl(meth)acrylates, and (iii) about 2 to about 4 weight percent monomer units of one or more nitrogen-containing dispersant monomers selected from the group consisting of dialkylaminoalkyl(meth)acrylates or dialkylaminoalkyl (meth)acrylamides or mixtures thereof, wherein the alkyl groups or aminoalkyl groups each independently contain 1 to about 8 carbon atoms.

2. The lubricating composition of claim 1 wherein the amount of the poly(meth)acrylate viscosity modifier is about 1 to about 5 percent by weight.

3. The lubricating composition of claim 1 wherein the viscosity modifier polymer comprises about 0.5 to about 5 weight percent monomer units of one or more $C_2$-$C_6$ alkyl (meth)acrylates.

4. The lubricating composition of claim 1 wherein the $C_{10}C_{16}$ alkyl(meth)acrylate comprises $C_{12-15}$ alkyl methacrylate.

5. The lubricating composition of claim 1 wherein the nitrogen-containing monomer comprises dimethylaminoethyl methacrylate or dimethylaminopropyl methacrylamide.

6. The lubricating composition of claim 1 comprising about 1 to about 5 percent by weight of a viscosity modifier polymer having a weight average molecular weight of about 200,000 to about 450,000 and consisting essentially of:

(i) 15 to about 22 weight percent methyl methacrylate monomer units;

(ii) about 75 to about 81 weight percent $C_{12-15}$ alkyl methacrylate monomer units; and (iii) about 2 to about 4 weight percent dimethylaminoethyl methacrylate monomer units.

7. The lubricating composition of claim 1 further comprising at least one of friction modifiers, antiwear agents, detergents, dispersants, antioxidants, phosphorus-containing zinc salts, pour point depressants, and antifoam agents.

8. A lubricating composition prepared by admixing the components of claim 1.

9. A method for lubricating an internal combustion engine comprising supplying thereto the lubricating composition of claim 1.

10. The lubricating composition of claim 1 wherein the amount of the poly(meth)acrylate viscosity modifier is about 1.5 to about 2.5 percent by weight.

11. The lubricating composition of claim 1 wherein the nitrogen-containing dispersant monomer is selected from the group consisting of dimethylaminoethyl(meth)acrylate, dimethylaminopropyl(meth)acrylamide, and mixtures thereof.

12. The lubricating composition of claim 11 wherein the amount of the poly(meth)acrylate viscosity modifier is about 1 to about 5 percent by weight.

13. The lubricating composition of claim 4 wherein the amount of the poly(meth)acrylate viscosity modifier is about 1.5 to about 2.5 percent by weight.

* * * * *